US005862835A

United States Patent [19]

Hellstrom

[11] Patent Number: 5,862,835

[45] Date of Patent: Jan. 26, 1999

[54] CONTROLLING A HIGH SPEED ASYNCHRONOUS MOTOR IN A WEAVING MACHINE

[75] Inventor: Jerker Hellstrom, Nol, Sweden

[73] Assignee: IRO AB, Ulricehamn, Sweden

[21] Appl. No.: 682,719

[22] PCT Filed: Jan. 31, 1995

[86] PCT No.: PCT/SE95/00088

§ 371 Date: Sep. 16, 1996

§ 102(e) Date: Sep. 16, 1996

[87] PCT Pub. No.: WO95/21281

PCT Pub. Date: Aug. 10, 1995

[51] Int. Cl.[6] ..... D03D 51/02

[52] U.S. Cl. ..... 139/1 E; 139/452; 139/110

[58] Field of Search ..... 318/800, 801; 139/1 E, 452, 110, 1 R

[56] References Cited

U.S. PATENT DOCUMENTS

| | | | |
|---|---|---|---|
| 4,100,942 | 7/1978 | Tshudi . | |
| 4,129,154 | 12/1978 | Bennelli | 139/110 |
| 5,306,993 | 4/1994 | De Fries et al. | 318/561 |
| 5,500,581 | 3/1996 | Hatanaka et al. | 318/801 |
| 5,522,434 | 6/1996 | Lindblom | 139/1 E |

FOREIGN PATENT DOCUMENTS

| | | |
|---|---|---|
| 0504105 | 9/1992 | European Pat. Off. . |
| 484445 | 8/1924 | Germany . |
| 587124 | 10/1933 | Germany . |
| 3247066 | 9/1986 | Germany . |

OTHER PUBLICATIONS

"ABB Handbok Industri," published 1993, ABB Industri–Gruppen, pp. 125–127. No English Translation.

*Primary Examiner*—Andy Falik

*Attorney, Agent, or Firm*—Pollock, Vande Sande & Priddy

[57] ABSTRACT

A drive device for a weaving machine has a motor control unit connected to an asynchronous motor. An electric supply network supplies the motor control unit with electric power which the motor control unit converts to have a substantially higher frequency. This higher frequency power is then supplied to the asynchronous motor causing the motor to operate at a high r.p.m. A speed reducing unit is connected between the motor and a drive shaft of the weaving machine. The speed reducing unit reduces the r.p.m. of the motor and the motor drives the weaving machine via the drive shaft at the r.p.m. of the weaving machine.

12 Claims, 2 Drawing Sheets

CONTROLLING A HIGH SPEED ASYNCHRONOUS MOTOR IN A WEAVING MACHINE

FIELD OF THE INVENTION

The present invention relates to a drive device in a weaving machine comprising an asynchronous motor which can be powered from an electric power supply network operating at conventional frequency, e.g. a frequency of 50 or 60 Hz, for example. The asynchronous motor exhibits, or is connected to, a motor control and drives a drive unit/drive shaft in the weaving machine via a speed-reducing unit.

The invention also relates to a device for increasing the efficiency in a weaving machine system comprising one or more weaving machines and in which a respective weaving machine can be driven by an asynchronous motor which can be powered from an electric power supply network. The invention also relates to a device in a weaving machine which can be driven by means of an asynchronous motor which in a drive system, actuates the drive unit/drive shaft of the weaving machine via a speed-reducing apparatus and in which at least one flywheel is arranged to smooth peaks of torque caused by the fact that the weaving machine, during the weaving cycle, has a varying torque requirement. Finally, the invention relates also to a device in a weaving machine which can be driven by means of an asynchronous motor which actuates the drive unit/drive shaft of the weaving machine via a speed-reducing apparatus and in which a computer apparatus is arranged to predict optimal weaving machine speed for a respective yarn character. By yarn character is here meant quality, thickness, etc.

Regarding the types of weaving machines in which the invention can be used, weaving machines of the "Air Jet", "Water Jet" type, gripper weaving machines, projectile weaving machines, etc. can be mentioned.

It is previously known to use an asynchronous motor to drive a weaving machine of the type in question. The motor size for the particular types of weaving machines can be within the range of about 3–6 kW and can operate at a rotation speed of between 1400 and 2800 r.p.m., i.e. 2 and 4-pole asynchronous motors are utilized. The rotation speed of the weaving machine can lie in the range 500–1200 r.p.m., which means that the drive apparatus in question comprises a speed-reducing unit between the asynchronous motor and the drive member/drive shaft of the weaving machine.

The rotation speed of the weaving machine is dependent, among other things, upon the mechanical strength of the yarn in question. Higher speeds of the weaving machine produce higher load on the yarn and vice versa. Changes to the speed of the weaving machine have thus generally involved altering the setting of the speed-reducing apparatus (e.g. by a change of wheel in the gearbox and by similar techniques).

It is also known, in connection with weaving machines and their utilized asynchronous motors, to make use of a motor control/motor controls. This usage has hitherto involved adjusting the existing rotation speed of the asynchronous motor downwards in relation to its normal operating speed. If, for example, the motor is designed to operate at the rotational speed of 2800 r.p.m., a downward adjustment has been made from a rotation speed close to this to a lower rotational speed, e.g. to a rotational speed of 2000 r.p.m. or higher. It is possible per se to adjust the rotational speed of a standard motor upwardly, but with the disadvantage that the torque falls in proportion to the rotational speed increase. Power losses have thereby been generated and the motor control as such has been regarded, moreover, as a purely additional auxiliary apparatus which gave rise to an additional investment cost. The above disadvantages have hitherto had to be offset by higher productivity or by lower profits.

The object of the invention is to propose a device which solves, among other things, these problems. The invention makes it possible, moreover, to use a smaller motor of substantially lower (e.g. 50% lower) weight. This, together with the increased efficiency, means that the motor control as such pays for itself within a relatively short (e.g. 6-month) running or usage period. it is essential to be able to run the respective weaving machine at optimal speed with regard to yarn type and yarn quality. It is therefore important that the asynchronous motor be able to operate with small variations above the optimal motor rotation. It is thereby possible to approach the optimal limit for the weaving speed, since there is no need to risk peaks of speed beyond the strength of the yarn due to uncontrollable speed variations/speeds. The invention solves this problem.

In order to achieve a good and even weaving quality, it is essential to obtain a certain or desired quantity of stored kinetic energy in the system, which is achieved by the invention. It is essential that optimally stored energy should be able to be acquired. Inadequately low kinetic energy produces rotation speed variations and excessively high kinetic energy produces long start times. Likewise, it is important that the dimensions and weights of components forming part of the weaving machine be reduced. This is also achieved by the invention, which enables the sizes and weights of the flywheel or corresponding sizes and weights to be substantially reduced.

Especially where weaving machines are run in two or three shifts, it is essential to increase the efficiency throughout the system. The need, for example, to use a large number of motor types and/or make a large number of voltage adjustments by means of transformers also have to be reduced. The invention solves this problem and proposes, for example, that the motor control provides the particular motor with a correct voltage irrespective of large differences in the supply voltage (line voltage). It is also essential that the mass moment of inertia should be kept at an optimal level and hence prevent the occurrence of large time delays upon stopping and starting of the weaving machines or rotation speed variations due to inadequate kinetic energy. This too is solved by the invention. There is also a general trend that the weaving machine should become more user-friendly and that, for example, manual setting functions can be substantially reduced. The invention solves this problem.

What can primarily be deemed to be characteristic of a drive device intended for a weaving machine is that the motor control is arranged to convert the frequency of the electricity network to a substantially higher frequency and hence procure for the asynchronous motor a substantially higher rotation speed compared with a case in which a corresponding conventional asynchronous motor is driven at the frequency of the electricity network and that the speed-reducing unit is arranged to reduce the substantially higher rotation speed to the (optimal) running speed of the weaving machine.

A device for increasing the efficiency in a weaving machine system is to be characterized by the fact that the respective asynchronous motor is connected to the power-supply network via frequency-increasing members which, to the asynchronous motor, produce a frequency which substantially exceeds the frequency of the network in order to obtain a marked overspeeding of the asynchronous motor and that the latter is assigned an electronic compensation member which stabilizes the input voltage of the asynchronous motor.

What can primarily be deemed to be characteristic of a device in a weaving machine in which at least one flywheel is arranged to smooth peaks of torque can primarily be deemed to be characterized by the fact that the asynchronous motor operates at a substantially oversped state and that the flywheel(s) is/are arranged in connection with the high-speed side of the drive system in order, on this, to procure storage of the most substantial part of generated kinetic energy within the system.

What can primarily be deemed to be characteristic of a device in a weaving machine in which a computer apparatus, using the fault statistics of the weaving machine as input data, is arranged to predict an optimal weaving machine speed for a respective yarn character is that the asynchronous motor can be fed via a frequency-increasing unit which substantially overspeeds the motor and that the frequency-increasing unit is controllable from the computer apparatus in order to relate the frequency increase, and hence the rotation speed of the motor, to the optimal-weaving machine speed.

The invention serves to indicate a new way of using a motor control function, which, instead of conventional downward adjustment of the rotation speed, is arranged to produce a substantial upward adjustment of the rotational speed. It also becomes possible, by virtue of the invention, to indicate means of adapting other components which are run jointly with the oversped asynchronous motor within the total drive system for the weaving machine.

BRIEF DESCRIPTION OF THE DRAWINGS

The present invention is to be described below, reference herein being made to the appended drawings, in which.

DETAILED DESCRIPTION OF THE PREFERRED EMBODIMENTS

Figure 1:
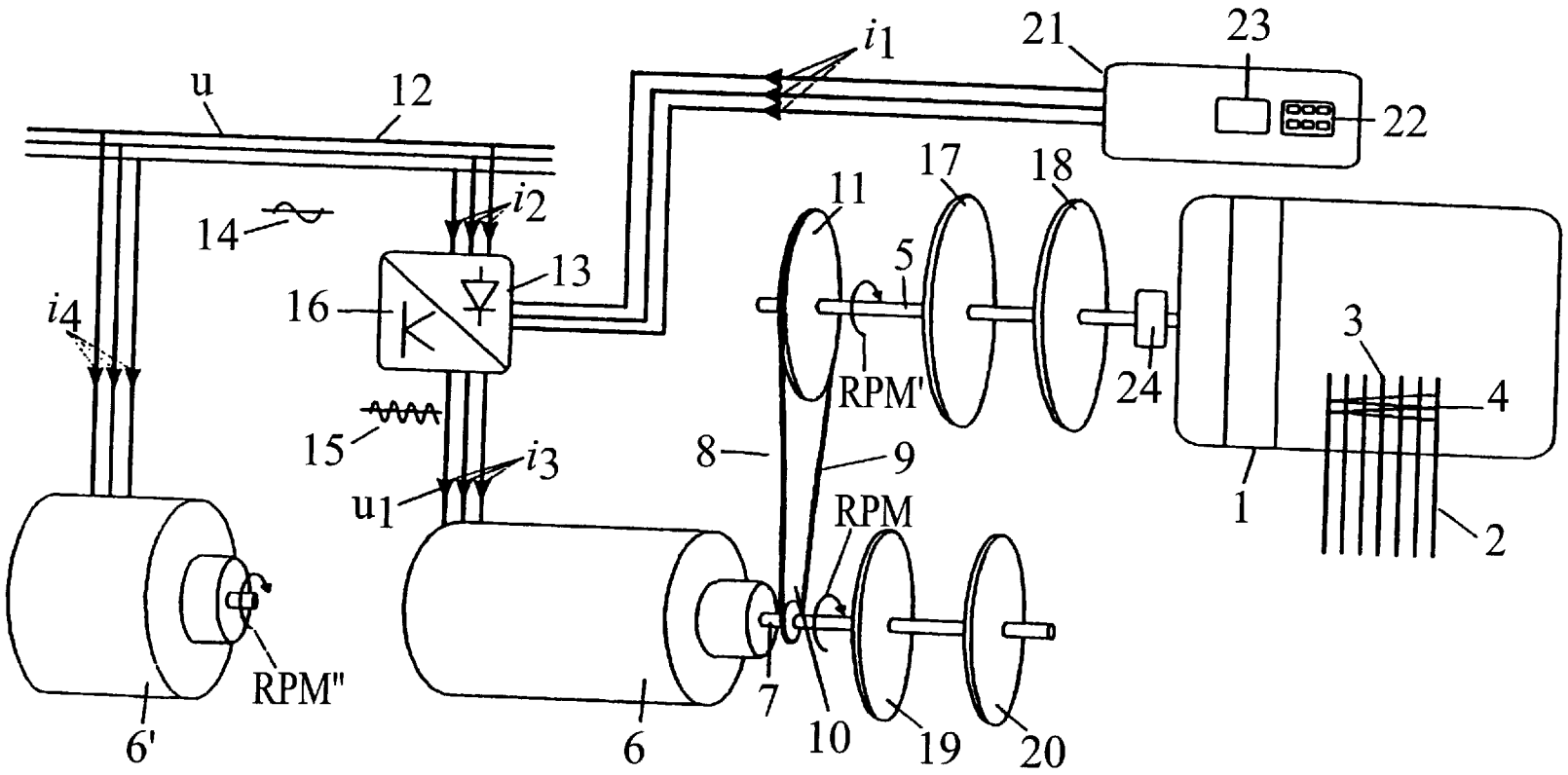
FIG. 1 shows the basic structure of a drive system for a weaving machine, comprising a computer apparatus for the control of the weaving machine.

In FIG. 1, a weaving machine is symbolized by 1. A weave produced with the weaving machine is indicated by 2 and warp threads by 3 and weft threads or weft yarn by 4. The weaving machine comprises a drive shaft/main drive shaft 5.

According to the invention, the drive shaft 5 can be driven by an asynchronous motor 6 which is provided with an output drive shaft 7. The driving of the drive shaft 5 of the weaving machine is effected via a speed-reducing apparatus 8, which in the illustrative embodiment comprises a drive belt 9. The shaft 7 is provided with a belt pulley 10 and the transmission to the drive shaft 5 of the weaving machine is effected by means of belt pulley 11. The diameters of the belt pulleys 10 and 11 determine the reduction of the rotational speed of the synchronous motor 6 to a rotational speed of the shaft 5 which is appropriate for the weaving machine. In the present illustrative embodiment, the rotational speed of the asynchronous motor 6 can range between 4000–10000 r.p.m. Preferably, a rotational speed in the range 8000–10000 r.p.m. is utilized. In the present case, the rotation speed is about 9000 r.p.m. The rotational speed RPM' of the weaving machine can lie within the range 500–1200 r.p.m.

The asynchronous motor 6 is electrically powered from an electricity network 12 of a known known type. Preferably, the public electrical mains are utilized. The invention can function for different frequencies of the electricity network. In Sweden, for example, the frequency is 50 Hz. The invention also functions however at 60 Hz, for example. The asynchronous motor 6 is connected to the electrical power supply network via a motor control 13, which is arranged to procure an increased frequency for the asynchronous motor. The motor control can increase the frequency, for example, by 100–500%. The increase depends upon the motor type and the number of poles on the asynchronous motor. The frequency on the network side is symbolized by 14 and at the output of the motor control, which output is connected to the asynchronous motor 6, by 15. The motor control can also comprise or be connected to a voltage-compensating electronic circuit 16. The electronic circuit is arranged to ensure that the nominal voltage of the asynchronous motor is maintained irrespective of the voltage U of the electrical power supply network. The motor control can thus be connected to input voltages within a relatively large range, e.g. an input voltage range between 200–575 volts. This means that the number of motor types for the asynchronous motor 6 can be substantially reduced.

In the figure, a conventional asynchronous motor is indicated by 6'. The conventional asynchronous motor can be connected in a conventional manner to the drive shaft 5 of the weaving machine via an apparatus, which downwardly adjusts the rotational speed, similar to the apparatus 8 according to the above. The asynchronous motor 6', having the rotational speed RPM', has been shown to indicate a comparative case in relation to the asynchronous motor 6. According to the invention, the asynchronous motor 6 shall be substantially oversped in relation to the conventional case involving the asynchronous motor 6'. The overspeeding function offers the advantage, among other things, that a substantial weight reduction can be achieved in relation to the case involving the asynchronous motor 6'. This weight reduction can be up to 50% or more. The conventional asynchronous motor 6' is assumed to be 2-polar, which means that its connection to the 50 Hz frequency of the electrical network 12 produces a rotational speed of about 2800 r.p.m. for the motor 6'. If this case is compared with the case in which the asynchronous motor 6 is 2-polar and operates at a frequency 15 of 130 Hz from the motor control, the rotational speed of the asynchronous motor 6 becomes about 9000 r.p.m.

In FIG. 1, two conventionally arranged fly-wheels for smoothing peaks of torque in the system have been shown by 17, 18. These flywheels are placed on the low-speed side of the system and are relatively large in terms of dimension and weight. These flywheels and the applications of the flywheels in the system are attributable to the conventional design of the asynchronous motor 6'. According to the invention, the flywheel function shall be arranged on the high-speed side of the drive system and in this case the flywheels have been indicated by 19 and 20 respectively. The application enables substantial reductions to be made in dimensions and weight in the last-named case. Thus, for example, the reduction in weight of the flywheels 19, 20 can be 75% of the weight of the flywheels 17, 18.

According to the inventive concept, the invention can be utilized in weaving machines comprising a computer control 21, which can be of a known type and therefore does not need to be here described in greater detail. The computer control comprises, for example, a keyboard assembly or actuating member 22 and an indicator panel 23. Into the computer apparatus can be programmed information on yarn type, yarn character, pattern, etc. Likewise, statistical data on the rotational speed of the weaving machine, e.g. the optimal rotational speed for a respective yarn character, can be programmed-in and stored. The motor control can also, in one embodiment, adapt the motor voltage to the asynchronous motor 6 irrespective of dynamic variations on the network with regard to frequency and voltage within specified variation ranges. The frequency adaptation can also be carried out in dependence upon signals i1 from the computer control 21. By means of the signals and controls, the frequency increase produced by the motor control 13 is thus able to be controlled, preferably with simultaneous voltage control according to the above, so that the frequency increase is related to the optimal weaving machine speed applicable to the yarn 4 in question, given a constant speed-reducing function. In FIG. 1, the supply current to the motor control is indicated by i2 and the output supply current from the motor control to the asynchronous motor 6 by i3. The nominal voltage to the asynchronous motor is indicated by U1. The signals i4 represent the input current to the asynchronous motor 6' in the said conventional case. In one embodiment, the adaptive setting of the rotational speed functions as follows: the computer of the weaving machine works out the optimal production speed, using the fault statistics of the weaving machine as input data. Speed information is transmitted to the motor control as a desired target value. If the cumulative stopping time of the machine is herein calculated to be excessive, the motor rotation of the asynchronous motor is reduced. Consequently, consideration can herein be given first to the yarn quality and second to the manning of the plant. The system as such becomes self-adjusting and the speed can be adapted according to operating stops/the number of faults, storage times, etc.

In the figure there is also shown a coupling 24 disposed between the flywheels 17, 18 and the drive shaft of the weaving machine.

By virtue of the above, a speed control is therefore integrated, procured by means of a frequency increase in the motor control 13. In a case, for example, in which the drive system is of the order of magnitude of 4.5 kW, a 1.5 kW 2-pole asynchronous motor can be utilized, which is therefore fundamentally envisioned for a rotation of 2800 r.p.m. 1.5 kW asynchronous motor is designed as a high-speed motor with better/good stator lamination quality, which yields the 4.5 kW at 9000 r.p.m. The belt drive is also adapted in accordance herewith and, by way of example, a so-called "Poly-Velt" belt drive can be utilized. The above offers a series of advantages. The efficiency is substantially improved as outlined below. No extra apparatus is required for inching and reversed motional direction. Large savings are achieved in terms of weight and costs. A 2-pole 4.5 kW asynchronous motor weighs about 28 kg. A 2-pole 1.5 kW asynchronous motor weighs about 13 kg and produces equivalent torque on the low-speed side by means of speed-reducing apparatus. A price reduction of about 40% can obtain for the asynchronous motor and the reductions can likewise be achieved by the use of fly-wheels. The motor control can be frequency-controlled and an optimized production speed can be set on the control panel of the weaving machine, see 21 above. Similar motors can be utilized for 50/60 Hz. A smaller number of motor types can be utilized, as can a smaller number of transformer sockets, in order to safeguard running within large variations in the supply voltage. The motor control can carry out compensations for various input voltages or supply voltages. An adaptive system which automatically adjusts to the optimal production speed can be arranged. Stable motor speeds can be achieved thanks to the motor control and the variations, in the embodiment of the invention, are only ⅓ of those in the case in which standard motors are used. The electronic motor control can be designed with a soft start-up and soft stoppage of the asynchronous motor, which should be compared with the standard case which very often produces high starting currents. Better adaptation to the first pick of the machine can be achieved. By running the motor at overspeed before activating the coupling, it is possible to eliminate the slow first pick. This function too reduces the size of the flywheel or flywheels.

According to the invention the asynchronous motor is designed to operate with substantial overspeeding, with better lamination quality in the stator in relation to the standard case. In addition, it is possible to exchange the shaft and bearing for a shaft and bearing of smaller size, e.g. a size which is one number smaller. The cooling operation can also be realized and can be made, for example, to form part of the belt drive. A high-drive belt is also utilized. The weaving machine and drive system can operate with a closed feedback loop and speed control which produces a 1–3% higher production speed. With a 2-pole asynchronous motor of the standard type for 4.5 kW, a loss is generated in the system at a maximum load of about 0.9 kW. This figure can in fact be improved, by some percent, thereby resulting in a higher price for the motor as such. A 4.5 kW motor with 84% efficiency can be improved to 86% efficiency at an additional cost of 10%. For the same additional cost percentage, a 1.5 kW motor can be improved from 79% to 85%, since in the case of small motors the production costs can be given priority over the efficiency rating. A 2-pole a synchronous motor of the high-speed type and 1.5 kW produces an efficiency of about 85% at maximum load and 2850 r.p.m. The losses at maximum load and 2850 r.p.m. are only-about 0.26 kW. The losses at maximum load and 8900 r.p.m. are about 0.27 kW. Compensations for variations in the supply voltage can herein be utilized. Better quality in the stator laminations provide compensations for high stator frequency. The loss of power in the motor control can be calculated at about 0.14 kW. An efficiency-increasing effect can thus be achieved by the invention which, in the present case, produces savings of about 0.4 kW.

As a result of the invention, 14 types of motor for 14 different voltages or 14 different transformer arrangements can be reduced to 5 types of motor and 5 transformer arrangements respectively within the voltage range 200–575 volts. The respective motor control can be arranged for 200–240 volts with ±10%; 260–346 volts with ±10% variation; 380–415 volts with ±10% variation; 440–480 volts with ±10% variation; and 550–575 volts with ±10% variation. By virtue of this division into 5 ranges, a technically simply constructed and cost-effective solution to the motor control can be achieved. In a system according to the above, there is a need to be able to store a kinetic energy of the order of magnitude of 3500 joules. The belt drive in the high-speed system yields at least 2800 joules. By enlarging the width of the belt pulleys, it is easy to achieve the necessary kinetic energy.

Figure 2:
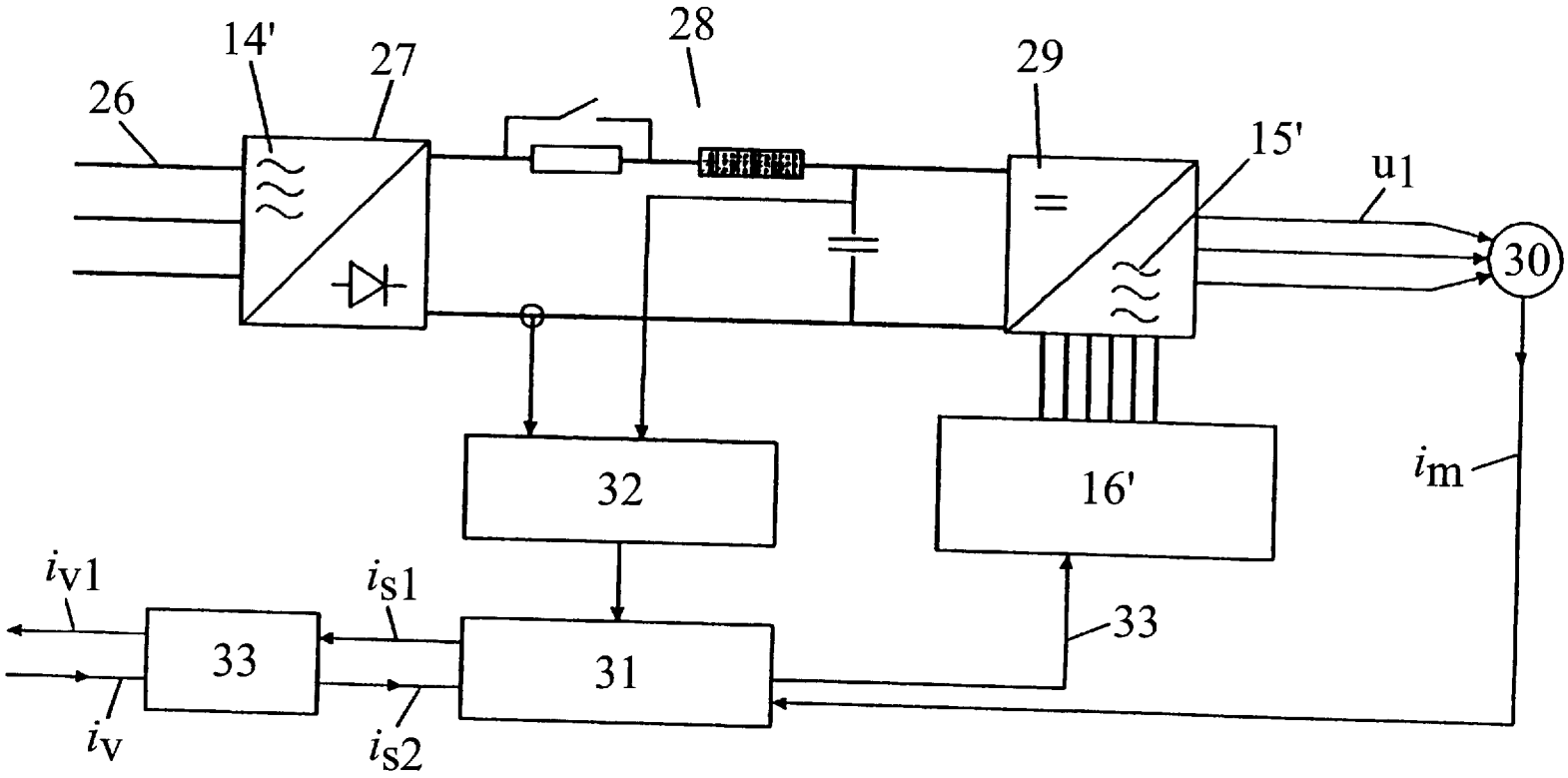
FIG. 2 shows, in block diagram form, an illustrative embodiment of the motor control function.

A motor control which meets the above-stated requirements shall be described, by way of example, with reference, among other things, to FIG. 2. In the present case, the motor control is 3-phase and is arranged for the voltage 340–456 volts and the frequency range 45–65 Hz. The output to the motor yields 4.5 kW at 8900 r.p.m. The ambient temperature is assumed to be 0°–50° C. and the working life of the device about 30000 running hours. The control comprises protection against over-temperature and has a voltage restriction incorporating upper voltage protection and lower voltage protection.

FIG. 2 shows a combined frequency-conversion and voltage-adaptation unit having components which are known. The motor control can be connected to a 3-phase network, e.g. to the public electricity mains network 26, via a rectifier unit 27, filtering unit 28 with filter and choke and a bridge unit 29 having, for example, six power transistors. By means of the components 27–29, the line frequency 14' is converted to the supply frequency 15' to the three-phase asynchronous motor 30. The bridge unit chops the direct-current voltage which is obtained from the units 27 and 28 and provides the motor with varying frequency. The voltage $U_1$ to the motor is adjusted with a voltage-adaptation unit 16' using so-called "PWM-technology" (of known type). A micro-computer (-controller) feeds input voltage and supply current via an AC/DC converter 32 and determines the correct lead times to the PWM-unit 16, which lead times are transmitted via a line (lines). The information $i_v$ on desired rotation speed and hence also frequency is acquired from the computer of the weaving machine, preferably in serial form. The rotational speed of the motor 30 is represented by a signal $i_m$, which is supplied to the microcomputer 31. The latter communicates also with the weaving machine via an adaptation unit 33. The said signal $i_v$ represents a target value which is acquired from the weaving machine, the computer of which works out the speed target value in dependence upon fault statistics and any other input data. The actual value $i_m$ of the motor 30 is fed back to the microcomputer. The latter also realizes information $i_{s1}$ and $i_{s2}$ to the computer of the weaving machine.

The weaving machine speed can thus be optimized at any moment or during any work stages.

The invention is not limited to the above embodiment shown by way of example but can be modified according to the following patent claims.

I claim:

1. A drive apparatus for driving a weaving machine at a specific rotational speed, said weaving machine having a drive shaft, said drive apparatus being relatively light in weight as compared to a conventional weaving machine drive apparatus, said drive apparatus comprising:

a motor control unit connected to an asynchronous motor and to an electric supply network, said motor control unit including a means for converting a frequency of said electrical supply network to a substantially higher frequency and supplying said motor with said higher frequency for operation at a higher rotational speed (r.p.m.); and a speed reducing unit connected between said motor and said drive shaft of said weaving machine, said speed reducing unit reduces the rotational speed (r.p.m.) of said motor whereby said motor drives said weaving machine via said drive shaft at the rotational speed (r.p.m.) of said weaving machine.

2. The apparatus according to claim 1 wherein said motor is approximately 50% of the weight of a conventional motor for a weaving machine which operates at the frequency of said electrical supply network.

3. The apparatus according to claim 1 further comprising a means for controlling said motor control unit to provide predetermined frequencies to said motor.

4. The apparatus according to claim 1 wherein said motor control unit further comprises:

a rectifier connected to said electric supply network, said rectifier providing a rectified signal;

a filter connected to said rectifier, which filters the rectified signal;

a bridge unit connected to said filter which chops the rectified signal and supplies said higher frequency to said motor.

5. An apparatus to increase the efficiency of a weaving system comprising:

at least one weaving machine driven by at least one asynchronous motor;

a means for increasing frequency connected to a power supply network and to said at least one motor, said means for increasing frequency providing a frequency substantially higher than a frequency of said power supply network to said at least one motor, whereby said motor is oversped; and an electronic compensation member connected to said motor which stabilizes a voltage input of the motor.

6. The apparatus according to claim 5 wherein said means for increasing frequency comprises:

a first member which measures the input voltage; and second members which, dependent upon said input voltage, supply said motor with a nominal voltage in a pre-determined range.

7. The apparatus according to claim 4 wherein said means for increasing frequency over speeds said motor within a range of 100–500% of its nominal rotational speed.

8. A drive apparatus for a weaving machine, having a drive shaft, and being relatively light in weight as compared to a conventional weaving machine drive apparatus, said drive apparatus comprising:

an asynchronous motor, and means for operating said motor at an oversped state, said motor adapted to actuate the drive shaft of said weaving machine via a speed-reducing unit; and at least one flywheel connected to a high speed side of the drive system for storing a substantial part of the generated kinetic energy.

9. The apparatus according to claim 8 wherein said flywheel is directly connected to an output shaft of said motor, said output shaft having a high r.p.m.

10. A drive apparatus for driving a weaving machine at a specific rotational speed, said weaving machine having a drive shaft, said:

a motor control unit connected to an asynchronous motor and to an electric supply network, said motor control unit including a means for converting a frequency of said electrical supply network to a substantially higher frequency and supplying said motor with said higher frequency for operation at a higher rotational speed (r.p.m.); and a speed reducing unit connected between said motor and said drive shaft of said weaving machine, said speed reducing unit reducing the rotational speed (r.p.m.) of said motor such that said motor drives said weaving machine via said drive shaft substantially at the rotational speed (r.p.m.) of said weaving machine; and a computer apparatus which predicts optimal weaving speeds for a specific yarn characteristic, said computer apparatus communicating with said motor control unit to control the higher frequency such that the weaving machine operates at an optimal speed.

11. The apparatus according to claim 10 further comprising:

a rectifier connected to said electric supply network, said rectifier providing a rectified signal;

a filter connected to said rectifier, which filters the rectified signal;

a bridge unit connected to said filter which chops the rectified signal and supplies said higher frequency to said motor.

12. The apparatus according to claim 10 wherein said motor control unit comprises a microcomputer which detects a rectified line voltage and controls a voltage determining unit which determines the voltage supplied to said motor; and wherein an actual rotational speed of said weaving machine is communicated to said microcomputer and compared with said optimal weaving speed, whereby said microcomputer adjusts said actual rotational weaving speed.

* * * * *

UNITED STATES PATENT AND TRADEMARK OFFICE

CERTIFICATE OF CORRECTION

PATENT NO. : 5,862,835
DATED : January 26, 1999
INVENTOR(S) : Jerker Hellstrom

It is certified that error appears in the above-identified patent and that said Letters Patent is hereby corrected as shown below:

On the title page,

Item [30] Foreign Application Priority Data

Feb. 2, 1994 [SE] Sweden.....9400331

Signed and Sealed this

Twenty-fifth Day of May, 1999

*Attest:*

Q. TODD DICKINSON

*Attesting Officer*

*Acting Commissioner of Patents and Trademarks*